US011794067B2

(12) United States Patent
Lammers

(10) Patent No.: US 11,794,067 B2
(45) Date of Patent: Oct. 24, 2023

(54) ROWING SIMULATOR

(71) Applicant: RP3 Rowing B.V., Haaksbergen (NL)

(72) Inventor: Gerrit Jan Lammers, Haaksbergen (NL)

(73) Assignee: RP3 Rowing B.V.

( * ) Notice: Subject to any disclaimer, the term of this patent is extended or adjusted under 35 U.S.C. 154(b) by 19 days.

(21) Appl. No.: 17/454,569

(22) Filed: Nov. 11, 2021

(65) Prior Publication Data

US 2022/0143456 A1 May 12, 2022

(30) Foreign Application Priority Data

Nov. 11, 2020 (NL) ..... 2026873

(51) Int. Cl.
*A63B 22/00* (2006.01)
*A63B 21/008* (2006.01)
(Continued)

(52) U.S. Cl.
CPC ..... *A63B 22/0076* (2013.01); *A63B 21/0084* (2013.01); *A63B 21/154* (2013.01);
(Continued)

(58) Field of Classification Search
CPC ..... A63B 22/0076; A63B 22/0087; A63B 22/0089; A63B 22/20; A63B 22/2021; A63B 22/203; A63B 22/208; A63B 2022/0079; A63B 2022/0082; A63B 21/00185; A63B 21/0084; A63B 21/015; A63B 21/018; A63B 21/04; A63B 21/0407; A63B 21/0442; A63B 21/06; A63B 21/0602; A63B 21/22; A63B 21/222; A63B 21/225; A63B 21/227
See application file for complete search history.

(56) References Cited

U.S. PATENT DOCUMENTS 8,708,867 B2 * 4/2014 Lumsden ..... A63B 21/0084 482/73
10,279,214 B2 * 5/2019 Chiang ..... A63B 21/0435
(Continued)

FOREIGN PATENT DOCUMENTS

DE 202017106745 U1 11/2017

OTHER PUBLICATIONS

Written Opinion and Search Report dated Jul. 21, 2021 from Patent Application NL 2026873.

*Primary Examiner* — Sundhara M Ganesan
*Assistant Examiner* — Zachary T Moore
(74) *Attorney, Agent, or Firm* — ST. ONGE STEWARD JOHNSTON AND REENS

(57) ABSTRACT

Exercise device, having at least one elongate track onto which a seat and a footrest are slidingly movably arranged, such that the seat and the footrest are mutually independently movable along the at least one track, a resistance element connected to a handle via a drive cord through which the resistance element can be driven upon pulling the handle towards the seat, and a cord guiding member arranged between the handle and the resistance element over which the drive cord passes, wherein the cord guiding member is arranged stationary with respect to the footrest, and wherein the resistance element is arranged stationary with respect to the at least one track.

20 Claims, 5 Drawing Sheets

(51) Int. Cl.
*A63B 21/00* (2006.01)
*A63B 21/22* (2006.01)

(52) U.S. Cl.
CPC .... *A63B 21/225* (2013.01); *A63B 2022/0079* (2013.01); *A63B 2220/35* (2013.01); *A63B 2220/833* (2013.01)

(56) References Cited

U.S. PATENT DOCUMENTS

| | | | | |
|---|---|---|---|---|
| 10,441,834 | B2 * | 10/2019 | Liu | A63B 69/06 |
| 10,449,410 | B2 * | 10/2019 | Hamilton | A63B 21/008 |
| 10,466,475 | B2 * | 11/2019 | Chen | A63B 24/0087 |
| 2001/0027150 | A1 | 10/2001 | Duke | |
| 2012/0100965 | A1 * | 4/2012 | Dreissigacker | A63B 22/0005 482/72 |
| 2013/0035216 | A1 * | 2/2013 | Campbell | A63B 21/0552 482/72 |
| 2016/0107023 | A1 * | 4/2016 | Campanaro | A63B 21/068 482/72 |
| 2018/0056117 | A1 * | 3/2018 | Hamilton | A63B 69/06 |
| 2018/0214734 | A1 * | 8/2018 | Lammers | A63B 21/225 |
| 2019/0262661 | A1 * | 8/2019 | Stepanian | A63B 21/00192 |

* cited by examiner

ROWING SIMULATOR

FIELD OF THE INVENTION

The present invention relates to an exercise device. In particular, the present invention relates to a rowing machine.

BACKGROUND OF THE INVENTION

A known exercise device comprises an elongated structural member extending in a longitudinal direction, a resistance element connected to said structural member for providing a resistance force, a seat connected to said structural member, and a drive means for driving said resistance element, said drive means comprising a handle to be held by a user, wherein said seat and said resistance element are both movable with respect to each other in a direction parallel to the longitudinal direction of said structural member.

A disadvantage of this known exercise device is that the resistance element being arranged on the structural member requires a bulky structure and/or an increased number of structural components in order to provide sufficient stability and rigidity to the device. Since such exercise devices are increasingly intended for domestic use, where space for exercising is limited, this bulkiness is considered a problem. An additional problem, which particularly arises in domestic use, is the significant amount of noise created by known exercise devices during use. Furthermore, there is increasing demand for exercise devices which provide an accurate simulation of rowing.

The present invention aims to alleviate at least one of the aforementioned problems and to provide a stable and rigid exercise device which is less bulky than known exercise devices and provides an accurate simulation of rowing.

SUMMARY OF THE INVENTION

To that end, the present invention provides an exercise device, comprising at least one elongate track onto which a seat and a footrest are slidingly movably arranged, such that the seat and the footrest are independently movable along the at least one track, a resistance element connected to a handle via a drive cord through which the resistance element can be driven upon pulling the handle towards the seat, and a cord guiding member arranged between the handle and the resistance element over which the drive cord passes, wherein the cord guiding member is arranged stationary with respect to the footrest, so that the cord guiding member moves with the footrest, and wherein the resistance element is arranged stationary with respect to the at least one track. In the industry, rowing simulators which allow the seat and footrest to move are typically referred to as "dynamic" simulators whereas those which have a fixed position footrest are normally referred to as "static" simulators. Because traditional "dynamic" machines commonly have the resistance element moving with the footstretcher, the options of available resistance elements is limited by this movement. Specifically, a liquid filled tank with a rotating paddle therein could not be reliably used with prior dynamic simulators as those designs would cause the tank to move back and forth and thus cause the water to slosh around and provide inconsistent resistance force for the user. In addition, the upper pulleys of these traditional dynamic machines will typically be fixed relative to the resistance unit and at the same time movable along the bar with the resistance unit.

The resistance element being arranged stationary with respect to the track in combination with the cord guiding member being stationary with respect to the foot rest enables using a less bulky structure, while maintaining sufficient stability and rigidity. Moreover, this arrangement allows using a resistance element which is heavier than that of the known exercise device and also enables a dynamic type machine to now use the much quieter liquid based resistance unit—typically a tank containing water and an impeller such as a paddle. As a result, the resistance force can be increased while achieving accurate rowing simulation accuracy or the more quiet resistance unit (i.e not an air resistance flywheel) can now be used with a dynamic style machine. On the other hand, in the known exercise device, wherein the resistance element is movably arranged on the structural member, a heavier resistance element would negatively affect the accuracy of the simulation of rowing. In other words, the influence of the weight of the resistance element on the rowing simulation accuracy is factored out due to the resistance element being arranged stationary with respect to the track. This allows use of a heavy resistance element which can provide an increased resistance force or a quieter resistance while achieving an accurate simulation of rowing. A further improvement of the rowing simulation accuracy is achieved by the cord guiding member being movable along the at least one track, in particular stationary with respect to the movable footrest, such that a force exerted by a user on the handle and a force exerted by the user on the movable footrest interplay and are coupled directly. Preferably, the cord guiding member is a pulley.

The exercise device is preferably configured to be used as follows. A user using the exercise device may sit on the seat and hold the handle. In a starting position of the exercise device, a distance between the seat and the footrest is such that the legs of the user seated on the seat and with his/her feet placed on the footrest are bent. The user may then push against the footrest using his/her quadriceps until his/her legs are (almost) straight, thereby increasing the distance between the seat and the footrest and pulling the handle, thereby driving the resistance element. The seat and the footrest are then in an extended position in which the legs of the user are (almost) straight and the distance between the seat and the footrest is maximal. After further pulling the handle, the user may then return the exercise device to the starting position, thereby reducing the distance between the seat and the footrest. The cycle may then be repeated.

Both the seat and the footrest may be directly or indirectly connected to the at least one track, either fixed or releasable. The footrest and the seat, are preferably moveably connected to the at least one track by means of guiding wheels or any other suitable means. The guiding wheels may be part of the footrest and/or the seat and may be arranged in a guiding rail of the at least one track or the guiding wheels may be part of the at least one track and may be arranged in guiding rails of the footrest and/or the seat.

The resistance element may provide a resistance force to resist the forces exerted by the user.

Being arranged substantially stationary with respect to each other herein is understood to mean that the general mutual position is unchanged. It is however possible to allow some relatively small mutual movement. As an example, the cord guiding member may be fixed to the footrest or a body having the footrest via a short spring or cord, so as to allow minor movement of the cord guiding member. Nevertheless, in such a situation, the general position of the cord guiding member remains unchanged with respect to the footrest and the body, and they are as such stationary with respect to each other. It is submitted the skilled person understands that such small movements are permitted within the definition of stationary, as the movements do not contribute to the motion required for exercising.

The cord guiding member may be mounted on or fixed to a body which comprises the footrest to provide the suitable substantially stationary position with respect to the footrest.

In one embodiment of the exercise device, the exercise device comprises a cord guiding system that transfers only mutual movement of the handle and the footrest via the drive cord to the resistance element, but not a unitary movement of the handle and the footrest.

Mutual movement of the handle and the footrest may in particular be movement of both the footrest and the handle towards or away from each other.

Unitary movement of the handle and the footrest may in particular be movement of both the footrest and the handle in the same direction at the same speed, so that a mutual position remains unchanged.

For example, when the footrest is pushed towards the front of the machine in the drive and the handle is pulled towards the back of the machine, the resistance element is engaged. In contrast, if the handle and footrest are both moved in the same direction, the resistance element is not engaged or engaged in a comparatively minimal way, e.g. less than 30%, less than 20% or less than 10% of the resistance of mutual movement.

Such an exercise device may more accurately simulate rowing.

In order to provide an advantageous engagement between the handle and the resistance element, the drive cord may comprise two longitudinal ends, one of which is fixed to the handle and one of which is stationary with respect to the footrest. The latter end may for instance be fixed to a body comprising the footrest. The drive cord may extend around a traveling pulley, which is movably arranged with respect to the resistance element, and preferably also with respect to the elongate member and/or the footrest and/or the handle. The resistance element may be coupled to the traveling pulley, so that movement of the traveling pulley requires the resistance element to engage. Accordingly, the resistance element may engage when the traveling pulley moves.

In such a configuration, mutual movement of the footrest and the handle may be free from resistance of the resistance element, as mutual movement of the handle and footrest does not cause the traveling pulley to move. In fact, such unitary movement of the footrest and handle may merely require the cord to move through the pulleys, but may not require movement of the traveling pulley. Accordingly, the resistance element is not actuated, and no resistance from the resistance element is felt by a user.

Said configuration, i.e. with movement of the traveling pulley causing engagement of the resistance element, may be applied regardless of whether the resistance element and/or the cord guiding member is stationary with respect to the elongate member or the footrest respectively.

The operation of the cord guiding system is described in more detail below with reference to FIGS. 3 and 4. It is however noted that the same behaviour may be encountered in different ways. As an example, electronically actuated resistance means may be programmed to perform the desired behaviour. Alternatively yet, the same behaviour may be obtained mechanically, for instance employing one or more freewheels.

Accordingly, the invention also relates to an exercise device as described herein, with or without the stationary arranged cord guiding member, which comprises a cord guiding system configured to actuate the resistance element upon movement of the handle with respect to the footrest, but not when the handle and the footrest move together in unison.

The cord guiding system may comprise the cord guiding member and a further cord guiding member arranged towards an end of the exercise device which end is opposite the seat, wherein the drive cord runs through the handle, the cord guiding member, and the further cord guiding member. Accordingly, the drive cord engages the cord guiding member from two different and opposite directions. On the one hand, the drive cord runs from the handle to the cord guiding member, in a direction coming from the seat and pointing towards the cord guiding member. On the other hand, the drive cord runs from the cord guiding member to the further cord guiding member.

Accordingly, a movement of the cord guiding member with respect to the at least one track tends to pull on the drive cord on one end, and slack or provide leeway on the other side. As such, the cord guiding member, and therefore also the footrest, can be moved with respect to the track without the drive cord encountering resistance provided by the resistance element, or with only a small amount of resistance.

As such, when a user pushes his feet without engaging or pulling the handle, no work can be performed effectively. This may more accurately simulate rowing, as when rowing movement of the feet without pulling using the paddles also encounters very little or no resistance.

The same advantage of more accurately simulating rowing may be achieved in any exercise device that allows movement of the footrest with respect to the at least one track at relatively little position as long as the handle is not engaged. This may for instance be achieved by a freewheel system applied to the cord, or by providing sufficient cord length between the handle and the cord guiding member.

The further cord guiding member may be arranged stationary with respect to the at least one track. In a preferred embodiment, the resistance element is arranged below the at least one track. Since the at least one track is positioned above the floor, a space is cleared below the at least one track. By arranging the resistance element below the at least one track, an efficient use is made of the space to limit the bulkiness of the exercise device.

In a preferred embodiment, the resistance element is suspended from the at least one track, or at least fixedly attached thereto via e.g. at least one frame member, such that it is arranged above a floor on which the exercise device is installed. By suspending the resistance element above the floor, no contact is made between the resistance element and the floor so that noise created by the resistance is not transferred to the floor. This is particularly beneficial when the exercise device is arranged on a raised floor beneath which other people live.

Alternatively, the resistance element may be arranged on the floor on which the exercise device is installed. Since the resistance element is supported by the floor in this way, the resistance element can be heavy without the need for a bulky structure for the exercise device.

In a preferred embodiment, the resistance element comprises a flywheel configured to generate drag upon rotation thereof, for instance air drag.

In a preferred embodiment, the flywheel is arranged horizontally, i.e. a diameter of the flywheel extends horizontally and a rotation axis thereof extends vertically. A horizontal arrangement allows compact integration of the flywheel below the track.

In a preferred embodiment, the flywheel comprises an impeller arranged in a closed container at least partially filled with liquid configured to provide resistance to the impeller upon rotation thereof. The impeller may be a paddlewheel or a waterwheel that is rotated by the drive cord when driven by the user. An advantage of such a resistance element is that the drag is generated by the liquid, preferably water. As a result, noise is reduced and the rowing simulation accuracy is increased. Preferably, the container is arranged to adjust the amount of liquid therein. In this way, the resistance force generated upon rotation of the impeller in the liquid can be adjusted.

Instead of a paddlewheel, it is possible to provide a flywheel, for instance provided with an optionally magnetic brake. The flywheel may comprise at least one blade in order to provide braking of the flywheel via its interaction with a surrounding medium such as air, or water in case it is at least partially immersed. It is noted paddlewheels are a specific example of flywheels, as they also operate on the principle of rotational inertia to provide a relatively accurate simulation of real life exercising.

In addition, the closed container may be provided with a sensor arrangement which is configured to sense rotation speed of the impeller through the closed container. This may be e.g. a magnet and pickup combination where the magnet is positioned on the impeller and the pickup is positioned outside the closed container. The pickup may be a magnetic sensor of any kind, for instance a magnetometer, or an induction coil. Optical sensors are also contemplated in combination with a container which is transparent or translucent in whole or in part. In this manner, the speed of the impeller can be measured, but the liquid will remain in the container and escape of the liquid (e.g. through spilling or evaporation) is minimized. The sensor arrangement may be configured to sense the rotational speed during both work and rest phases in operation of the exercise device. The work phase may be the phase in which a user pulls the handle. The rest phase may be the phase in which the user returns the handle towards the position it was pulled from.

This departs from prior impeller and liquid based resistance units in that those prior units would typically utilize a sensor that only measures the speed with which the cord or device acting on the impeller travels during the work or "drive" phase in rowing. The added advantage of measuring through the closed container is that the speed and acceleration (deceleration) of the impeller during the recovery phase when the user is not applying force can be measured to determine the resistance or drag factor of the resistance unit. Devices that only measure speed in the work direction suffer the disadvantage that their work or performance indication will vary depending on how much liquid is placed in the container. Thus a higher score can be obtained simply by removing some liquid. As a result, the performance figures in those prior systems are not repeatable and accurate. The ability to read through the container allows for both measurement of acceleration and deceleration of the impeller and thus provides this added accuracy and repeatability of performance indications.

It is noted that any rotating body that has a rotational moment of inertia and provides an appropriate resistance to rotation is herein referred to as flywheel. As such, a paddlewheel or waterwheel can be referred to as an impeller, but at the same time also as a flywheel.

In a preferred embodiment, the exercise device further comprises a body which is slidingly movably arranged onto the at least one track, wherein the footrest and the cord guiding member are mounted on the body. The body can enable both the footrest and the cord guiding member to be stationary with respect to the body and thereby with respect to each other. Since the footrest and the cord guiding member are mounted on the body, a movement of the body is paired with movement of the footrest and the cord guiding member. The body being slidingly movably arranged onto the at least one track particularly allow movement of the body, the footrest and the cord guiding member to be a horizontal movement along the at least one track during use.

Such an arrangement departs from e.g. US2012/0100965 A1 to Dreissigacker which has a pulley 106 arranged above the bar 126 where that pulley 106 is stationary with respect to the bar and the footrest 112 moves along the bar 126 relative to that pulley 106. Changing the arrangement of the pulley 106 would fundamentally alter the Dreissigacker cabling system in a way that is not suggested or contemplated by that reference. However it has been discovered by the present inventors that the result of this property of the Dreissigacker rowing machine with the stationary resistance unit, moving foot rest, stationary pulley and moving seat and associated cabling and connection to the handle is that the feeling of on water rowing that a dynamic simulator seeks to provide is negatively impacted. Stated differently, the dynamic advantages of movement of both the seat and footrest are destroyed at least in part. In comparison, the present system's arrangement of the pulley, resistance element and footrest and their described positioning and relative movement constraints allows for improvement to the dynamic feeling of the machine relative to the Dreissigacker reference. The inventor has discovered that a combination of the stationary resistance unit with seat and footrest moving and that the pulley (or other cord guiding member) also moves with the footrest enables this better rowing motion simulation that is more in line with traditional dynamic simulators where the resistance unit would move. This improvement allows for the quieter liquid based resistance units of the type described herein to now be used in a dynamic rowing simulator where they otherwise could not be used effectively.

In a preferred embodiment, the cord guiding member is mounted on the body at a distance from the at least one track, preferably at approximately equal height as the handle when held by a user during use of the exercise device. To this end, the cord guiding member may be arranged on the body at a distance from the at least one track. The cord guiding member may be mounted above the at least one track. A height of the cord guiding member with respect to the frame may correspond to an upper body length of an average person, e.g. the height may be approximately 50 cm, for instance between 40 and 60 cm, preferably between 45 and 55 cm, most preferably approximately 50 cm. In any case, a height of at least 20 cm would be preferable and it is also preferable that this height over the track is constant. The cord guiding member being arranged at the same height as the handle enables the drive cord between the handle and the cord guiding member to be substantially horizontal and therewith parallel to the at least one track and the direction of movement of the seat and/or the footrest. The direction of the force exerted by a user on the handle through the horizontal part of the drive cord is equally parallel, and preferably opposite to, the direction of the force exerted by the user on the footrest. Consequently, the (reciprocal) movement of the handle and the movement of the cord guiding member are similarly parallel to the at least one track. As such, the cord guiding member and the handle being at equal height enables the exercise device to effectively simulate rowing, because the forces exerted by a user interplay. Furthermore, the cord guiding member being arranged at the same height as the handle contributes to providing an ergonomic exercise device that helps a user maintain a proper posture during use of the exercise device.

In a preferred embodiment, the drive cord is directly connected to the resistance element, such that a pulling force exerted on the handle and a resistance force provided by the resistance element are coupled directly. This improves the accuracy of the simulation of the rowing movement. In addition, a direct connection between the drive cord and the resistance element results in the exercise device having a small number of components, which may contribute to a simple setting up of the exercise device.

Alternatively, the drive cord is indirectly connected to the resistance element via a traveling pulley, such that a pulling force exerted on the handle and a resistance force provided by the resistance element are coupled indirectly.

In a preferred embodiment, the exercise device further comprises a bias element configured to urge each of the handle and the footrest towards a starting position, being the position of the handle and the footrest when no external force is applied. The bias element thereby enables the exercise device to be in the starting position at the start of the use of the exercise device by a user, the bias element may enable the user to only having to exert a force when pulling the handle and pushing the footrest towards an extended position, such that from the extended position the user does not need to pull back the footrest towards the starting position, which would allow the user to properly use the exercise device for specific muscles. Preferably, the bias element may be a spring.

In a preferred embodiment, the exercise device further comprises a tensioner configured to apply a force on the drive cord so as to create and maintain tension on the drive cord. In case of a flexible drive cord, a problem may occur with the drive cord not having tension. Forces exerted by a user would then first provide tension to the drive cord before accelerating the components of the exercise device and driving the resistance element. The tensioner therefore enables the forces exerted by a user on the handle and the footrest to be directly coupled and transferred through the drive cord to drive the resistance element. Preferably, the tensioner is integrated with the bias element.

In a preferred embodiment, the resistance element is connected via the drive cord to the footrest such that the resistance element can be driven through the drive cord upon pushing the footrest away from the seat. A force exerted on the footrest by a user is then directly coupled to the resistance element such that the connection between the footrest and the resistance element can directly drive the resistance element upon exerting a force on the footrest for an improved simulation of rowing.

In use, the at least one track is orientated such that the at least one track is substantially horizontal. The at least one track may for instance be a beam. Said beam may have any suitable cross-sectional shape, preferably a quadrangular, in particular square shape. Alternatively, the at least one track may be a plate-like member. Preferably, the at least one track may be constituted by a single track, wherein both the seat and the footrest are slidingly movably arranged on the single track.

In another preferred embodiment, the at least one track comprises a first track and a second track, wherein the seat is slidingly movably arranged on the first track and the footrest is slidingly movably arranged on the second track, wherein the first and second tracks are parallel to each other. A division of the at least one track into a first track and a second enables using different structures for each of the tracks, thereby allowing optimization of the ratio between weight and structural rigidity.

Preferably, the first track is arranged higher than the second track. This allows arranging the footrest on the second track close to the second track, which benefits the rowing simulation accuracy. At the same, a height difference is realized between the seat and the footrest, which ensures a correct seating position to be able to make a good and powerful rowing movement.

In a preferred embodiment, the first track comprises a resilient plate-like member onto which the seat is slidingly movably arranged, wherein the resilient plate-like member has a spring constant such that a vertical position of the seat is lowered by the weight of a user seated on the seat. Under the influence of the weight of the user, the resilient member bends and the seat lowers, such that the first track becomes arc-shaped, the radius of which decreases with an increasing weight thereon. The first track being arc-shaped results in a restoring force that counteracts a movement of the seat along the first track away from the lowest point on the resilient plate-like member. This resistance is intended to keep the user in place when the footrest is pushed away from the seat and pulled towards the seat by the user. This has been found to improve the rowing simulation accuracy.

Logically, the heavier the user the more the resilient plate-like member bends downwardly. Consequently, the resistance is increased, which is convenient as heavier users tend to be more powerful and therefore need a larger restoring force to stay in place.

It is noted the track comprising the resilient plate-like member could also be applied to an exercise device of other types, such as exercise devices with movable resistance elements and/or fixed footrests. In fact, the advantages provided by the resilient plate-like member could be achieved independent of the presence of a cord guiding member that is stationary with respect to the footrest. Actually, the plate-like member could be applied to any rowing simulator having a movable seat.

The same holds true as to the features related to the sensor that senses the impeller movement through the closed container which contains e.g. liquid in that such a sensor arrangement can be utilized to improve the closed container/impeller/liquid style resistance units, including those applied to "static" machines with a fixed foot rest and movable seat similar to the Waterrower® or Concept2® machines known to those of skill in the art. Typical air flywheel machines place the sensor entirely within any housing of the flywheel in that the e.g. magnet is not read through the housing by the pickup in prior art systems.

In a preferred embodiment, the exercise device is a rowing machine.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary and are intended to provide an overview or framework to understand the nature and character of the claims.

BRIEF DESCRIPTION OF THE DRAWINGS

The accompanying drawings are included to provide a further understanding and are incorporated in and constitute a part of this specification, wherein.

DETAILED DESCRIPTION OF THE INVENTION

Directions such as vertical and horizontal are used to provide information on the orientation of parts in a normal use of the exercise device. Front and rear are defined as seen by a user using the exercise device in a normal way.

Figure 1:
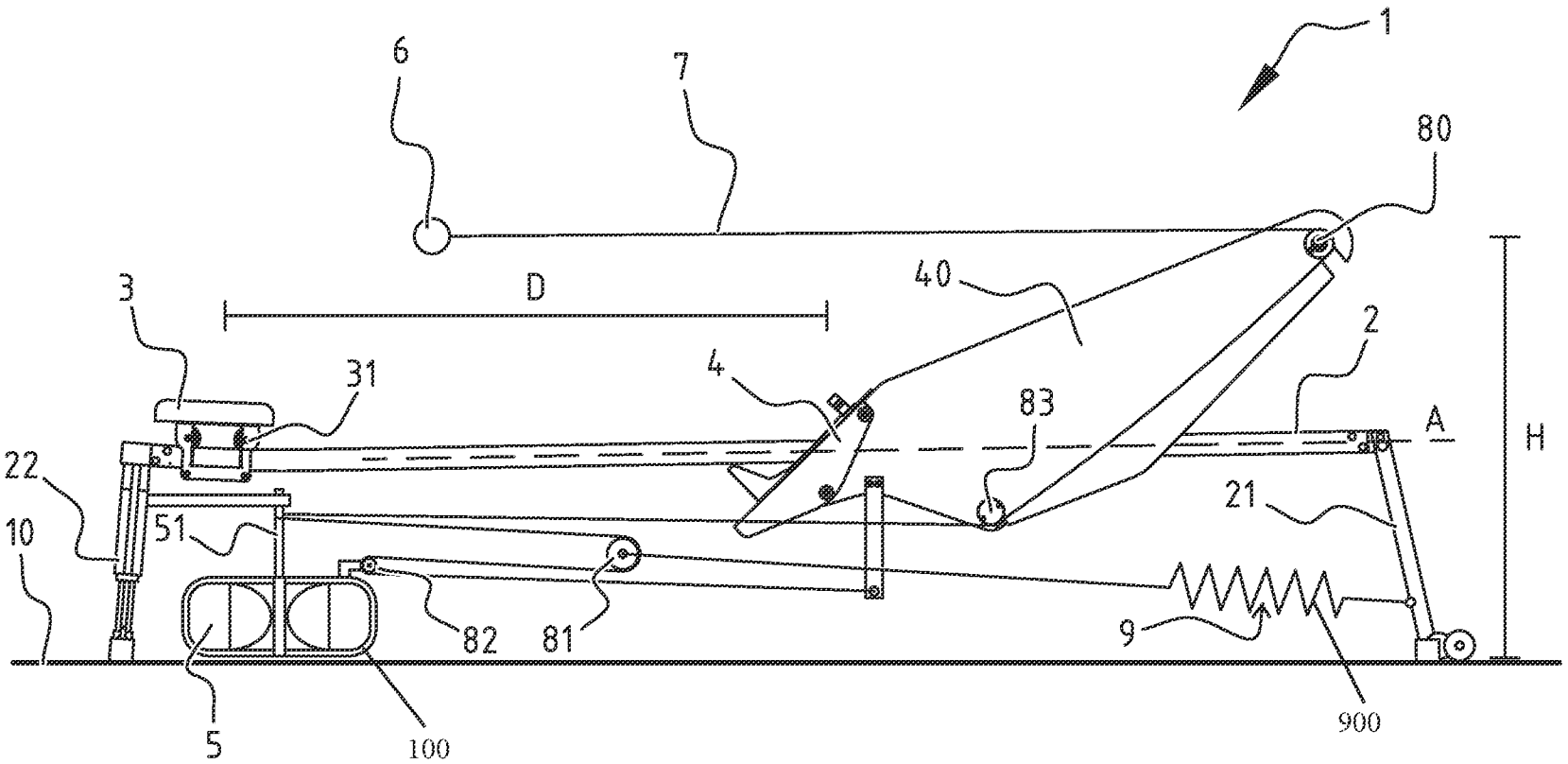
FIG. 1 shows a side view of a preferred embodiment of the exercise device according to the invention in a first position.

FIG. 1 shows a preferred embodiment of an exercise device 1, being a rowing simulator, also known as a rowing machine. The exercise device 1 comprises a single horizontally extending track 2, a seat 3 and a footrest 4. The track 2 has the shape of a beam and is supported at each free end. At the front end the track 2 is supported by a front leg 21 and at the rear end the track 2 is supported by a rear leg 22. The front leg 21 and the rear leg 22 support the track 2 on a floor 10 on which the exercise device 1 is installed at a position above the floor 10. Towards the rear end the track 2 is slightly bent such that the seat 3 moves slightly upward near the rear end of the track 2 when moving toward the rear end. The seat 3 and the footrest 4 are slidably arranged onto the track 2, such that the seat 3 and the footrest 4 are mutually independently moveable along the track 2. The seat 3 is provided with guiding wheels 31. The exercise device 1 further comprises a resistance element 5, a handle 6 and a cord 7. The resistance element 5 comprises a fluid filled container with a paddlewheel arranged therein, which provides a resistance force upon rotation of the paddlewheel in the fluid. In preferred embodiments, this fluid is a liquid such as water. Resistance element 5 is arranged stationary with respect to the track 2 and connected to the rear leg 22 to prevent the resistance element 5 from moving relative to the track 2. The resistance element 5 is connected to the handle 6 via the cord 7. The cord 7 is configured around a shaft 51 of the resistance element 5. The shaft 51 is connected to the rear leg 22 to prevent the shaft 51 from tilting under the influence of forces transferred by the cord 7. The resistance element 5 can be driven through the cord 7 upon reciprocal (linear) movement of the handle 6. The exercise device 1 further comprises a pulley 80, seen along the cord 7. The pulley 80 is arranged between the handle 6 and the resistance element 5 such that a direction of movement of the cord 7 on the side of the handle 6 is opposite to that on the side of the resistance element 5. The pulley 80 and the footrest 4 are mounted on a body 40 that is slidably arranged on the track 2, such that the pulley 80 is further arranged stationary with respect to the footrest 4. The pulley 80 being movable with respect to the track 2 improves the simulation of rowing. The pulley 80 is mounted on the body 40 at approximately equal height H as the handle 6 held by a user during use, as shown in FIG. 1. In FIG. 1, the exercise device 1 is in an extended position, i.e. in a position in which legs of a user are (almost) straight and a distance between the seat 3 and the footrest 4 is maximal. The exercise device 1 further comprises a bias element 9 having a tensioner 900 for urging the exercise device 1 to the starting position when a user provides no or little force to oppose the bias. The bias element 9 is connected to a travelling pulley 81, around which the cord 7 is configured. The travelling pulley 81 is arranged to guide the cord 7 between, seen along the cord 7, the resistance element 5 and an end of the cord 7 connected to the footrest 4. The cord 7 is further configured around a stationary pulley 82 arranged to guide the cord 7 between, seen along the cord 7, the travelling pulley 81 and the end of the cord 7 connected to the footrest 4. The stationary pulley 82 is provided on a housing of the resistance element 5. A second body-mounted pulley 83 is mounted on the body 40 and arranged to guide the cord 7 between, seen along the cord 7, the pulley 80 and the resistance element 5. Since the pulley 80 is at approximately equal height H with the handle 6, the cord 7 is configured around the second body-mounted pulley 83 to be substantially horizontal, or parallel to the track 2, when driving the resistance element 5. The resistance element 5 is arranged on the floor 10 on which the exercise device 1 is installed, below the track 2, in particular near the rear end of the track 2. The resistance element 5 is arranged horizontally, wherein the shaft 51 is arranged vertically such that a rotational axis of the resistance element 5 is arranged vertically and is aligned with the shaft 51.

Figure 2:
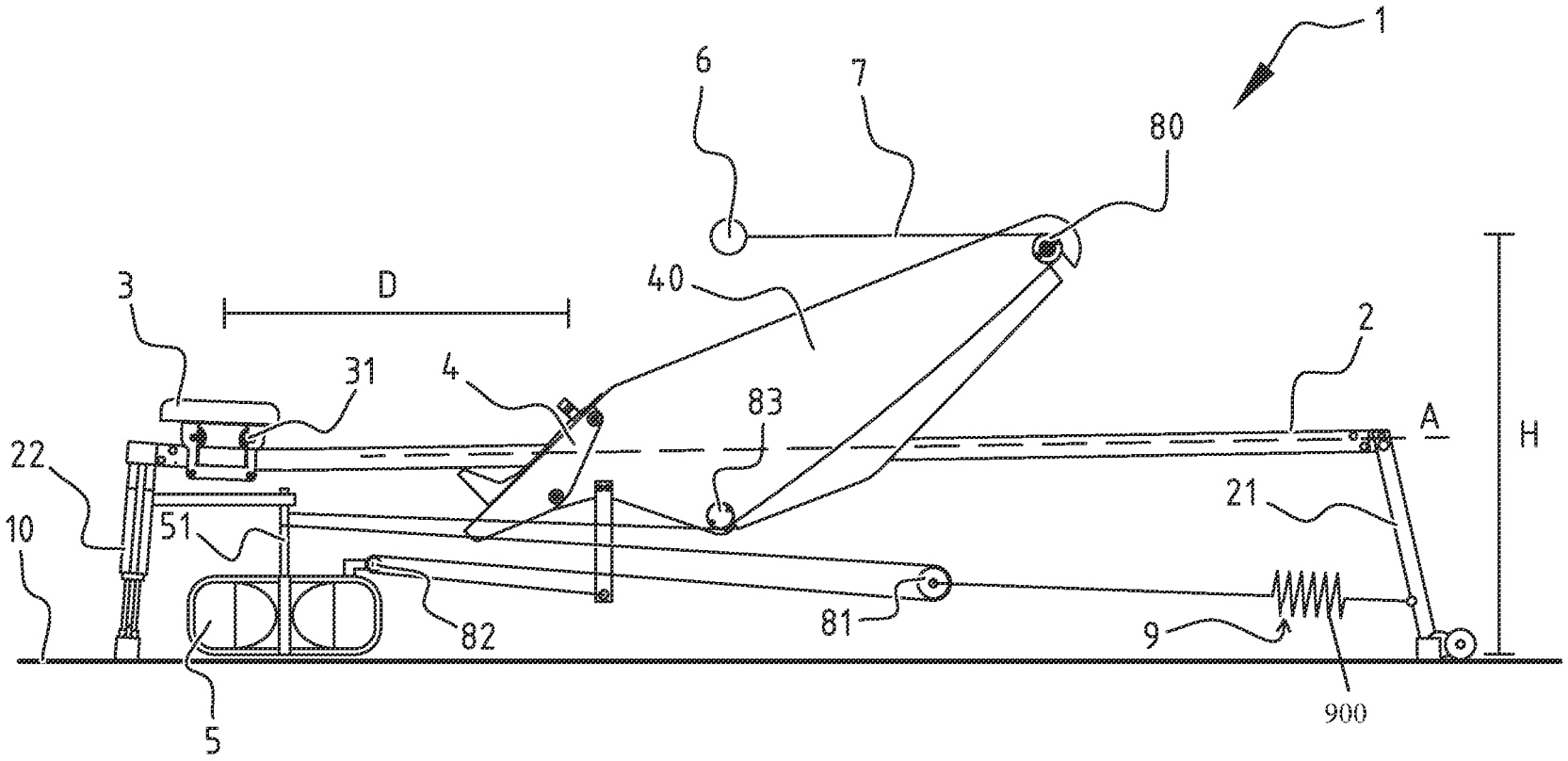
FIG. 2 shows a side view of the exercise device of FIG. 1 in a second position.

In FIG. 2, the exercise device 1 of FIG. 1 is in a starting position, i.e. in a position in which a distance between the seat and the footrest is such that the legs of the user seated on the seat and with feet placed on the footrest may be bent. The bias element 9 can be seen biasing the traveling pulley 81, and therewith the exercise device 1, toward the starting position. Positioning of the traveling pulley 81 in a direction along at least the longitudinal axis A of the track 2 may result in a sliding of the footrest 4 in an opposite direction along the longitudinal axis A. In the starting position, the distance D between the seat 3 and the footrest 4 is reduced.

Figure 3:
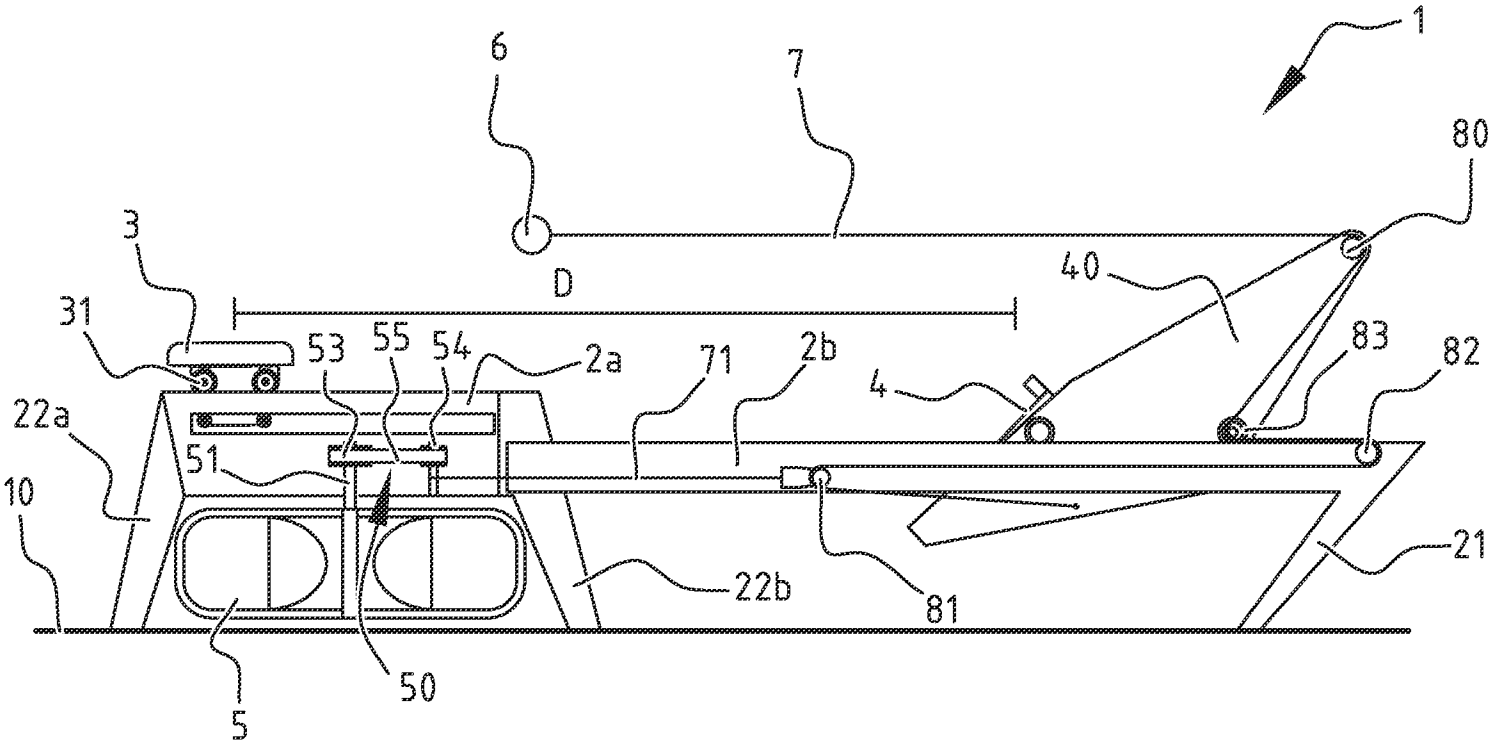
FIG. 3 shows a side view of another preferred embodiment of the exercise device according to the invention in the first position.

In FIG. 3, another preferred embodiment of the exercise device 1 is shown. Exercise device 1 is again in an extended position in which the legs of the user are (almost) straight and the distance between the seat and the footrest is maximal. The exercise device 1 comprises a first track **2*a* and a second track 2*b*, wherein the seat 3 is connected to the first track 2*a* and the footrest 4 is connected to the second track 2*b*. The first track 2*a* is positioned higher than the second track 2*b*. The tracks 2*a*, 2*b* have the shape of a beam and are each supported at each free end. At the front end the second track 2*b* is supported by a front leg 21. At the rear end the first track 2*a* is supported by a first rear leg 22*a*. The first track 2*a* is supported at the front end of the first track 2*a* by a second rear leg 22*b* connected the second track 2*b* to the first track 2*a*. The front leg 21 and the rear legs 22*a*, 22*b* support the track 2 on a floor 10 on which the exercise device 1 is installed at a position above the floor 10. The seat 3 and the footrest 4 are slidably arranged onto each respective track 2*a*, 2*b* such that the seat 3 and the footrest 4 are mutually independently movable along each respective track 2*a*, 2*b*. The seat 3 is provided with guiding wheels 31. The exercise device 1 further comprises a resistance element 5, a handle 6 and a cord 7. The resistance element 5 is arranged stationary with respect to the first track 2*a* and the second track 2*b*. The resistance element 5 is connected to the handle 6 via the cord 7. The exercise device 1 further comprises a pulley 80, seen along the cord 7. The pulley 80 and the footrest 4 are mounted on a body 40 that is slidably arranged on the track 2, such that the pulley 80 is arranged stationary with respect to the footrest 4 so that the pulley 80 moves along the track's longitudinal direction with the footrest 4. The exercise device 1** further comprises a traveling pulley 81, around which the cord 7 is configured. The traveling pulley 81 is arranged to guide the cord 7 between, seen along the cord 7, the resistance element 5 and an end of the cord 7 connected to the footrest 4. The resistance element 5 can be driven through the cord 7 via movement of the traveling pulley 81 upon reciprocal (linear) movement of the handle 6. The resistance element 5 is then driven by the movement of the traveling pulley 81 through a second cord 71 connecting the traveling pulley 81 to the resistance element 5. The cord 7 is further configured around a stationary pulley 82 arranged to guide the cord 7 between, seen along the cord 7, the traveling pulley 81 and the pulley 80 mounted on the body 40. The stationary pulley 82 is provided at the front end of the second track 2*b*. The stationary pulley 82 forms a further cord guiding member as described above, and is arranged at a side of the exercise device 1 away from the seat 3. A second body-mounted pulley 83 is mounted on the body 40 and arranged to guide the cord 7 between, seen along the cord 7, the pulley 80 and the stationary pulley 82 such that the cord 7 is configured around a larger circumference of the pulleys 80, 82 to improve the guiding of the cord 7 by the pulleys 80, 82. The further cord guiding member 82, the cord guiding member 80 and the second body-mounted pulley 83 are part of a cord guiding system which transfers only mutual movement of the handle 6 and the footrest 4 via the cord 7 to the resistance element 5. For this purpose, the cord guiding system includes a traveling pulley 81, movement of which engages the resistance element 5. The resistance element 5 is arranged at a height above the floor 10 on which the exercise device 1 is installed, below the track 2, in particular below the first track 2*a* between the rear legs 22*a*, 22*b*. By arranging the resistance element 5 above the floor 10, noise produced by the resistance element 5 during use of the exercise device 1 can be reduced. The resistance element 5 is arranged horizontally, wherein the shaft 51 is arranged vertically such that a rotational axis of the resistance element 5 is arranged vertically and is aligned with the shaft 51. Onto shaft 51 a first gear wheel 53 is arranged, which is part of a transmission 50 together with a second gear wheel 54 and a transmission belt 55. Transmission 50 allows adjusting the resistance force acting on the handle 6 when pulling the handle 6 towards the seat 3. It is noted that transmission 50 is only optional. Embodiments not including the transmission 50, i.e. wherein the drive cord is connected to shaft 51 directly, also fall within the scope of the present disclosure.

Figure 4:
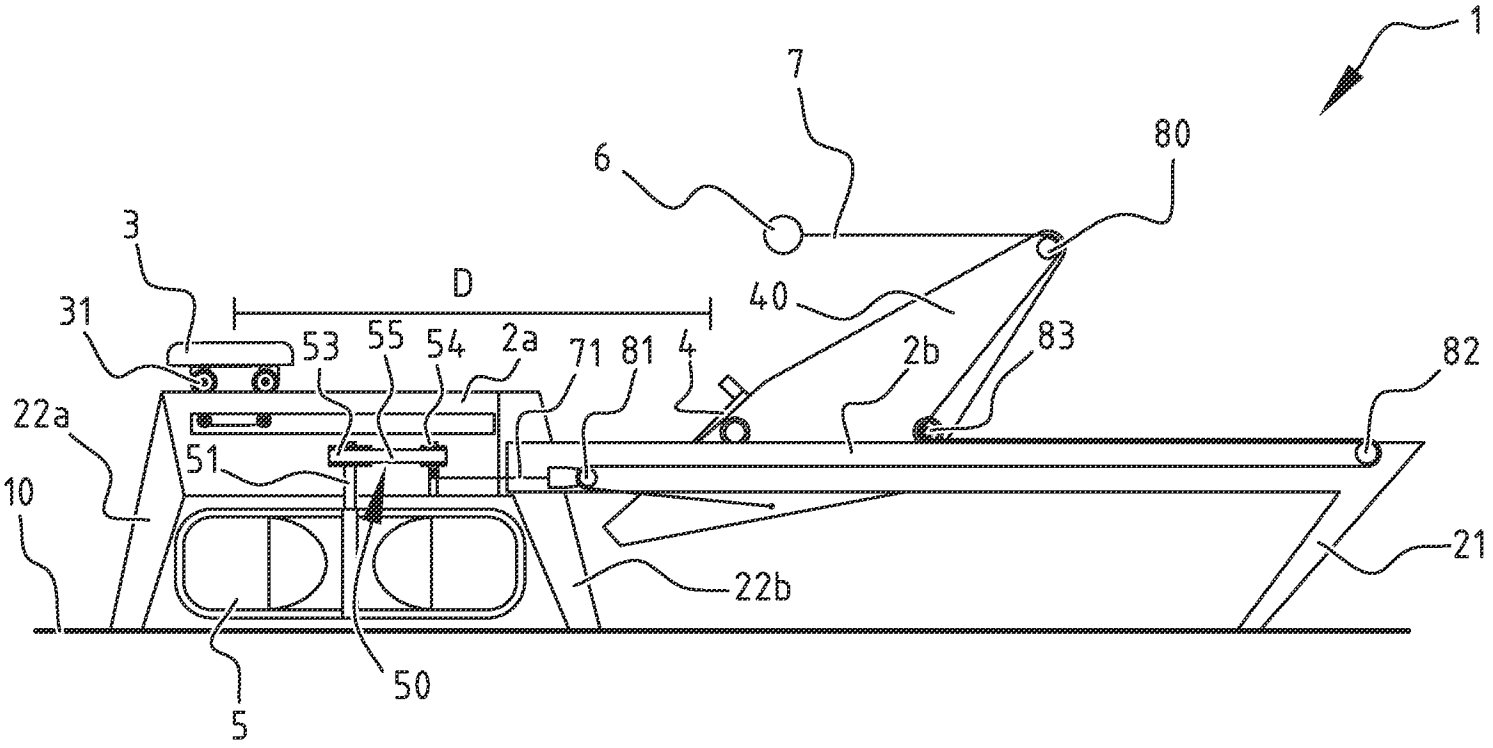
FIG. 4 shows a side view of the exercise device of FIG. 3 in the second position.

In FIG. 4, the exercise device 1 of FIG. 3 is shown in a starting position in which a distance between the seat 3 and the footrest 4 is such that the legs of the user seated on the seat 3 and with feet placed on the footrest 4 may be bent. In the starting position, the distance D between the seat 3 and the footrest 4 is reduced. The traveling pulley 81 is positioned toward the resistance element 5 and the handle 6 and the pulley 80 are positioned toward each other.

The cord guiding system of the exercise device 1 of FIGS. 3 and 4 operates as follows.

First, it is noted that from e.g. the starting position shown in FIG. 4, the body 40 and footrest 4 can move freely to the right, without activation of the flywheel, as long as the handle 6 is moved equally, i.e. when there is no mutual movement between the handle 6 and footrest 4. This can be seen as follows. With no mutual movement of the handle 6 and footrest 4, the section of the cord 7 between the handle and the pulley 80 on the body remains equal. Any movement of the body 40 to the right in FIG. 4, would result in a shorter distance between the pulleys 83 and 82. Since the cord 7 remains of equal length, there is a slack in the cord 7 between the pulleys 82 and 83 equal to the movement of the body 40 (and of the handle 6). At the same time, a distance between the body 40, specifically the point 500 at which the cord 7 is connected thereto, and traveling pulley 81 increases. The increase in distance of the body 40 with respect to the traveling pulley 81 is equal to the decrease in distance between the pulleys 82 and 83. Accordingly, the slack between pulleys 82 and 83 is taken up by the increased distance between the connection point 500 on the body 40 and the traveling pulley 81. Accordingly, the movement of the body 40 together with equal movement of the handle 6 can take place without having to move the traveling pulley 81. The total distance spanned by the cord 7 between its point of connection 500 on the body, and the pulley 80 on the body 40 nearest to the handle 6 remains equal. As such, the movement of the body 40 with the handle 6 only requires the cord 7 to move through the pulleys 80, 83, 82, 81, but does not require displacement of the traveling pulley 81 with respect to the elongate member 2 of the exercise device 1. As the traveling pulley 81 remains in place, there is no additional force on or movement of second cord 71, so that the resistance element 5 is not actuated. Accordingly, the movement of the body 40 together with the handle 6 does not drive the resistance element 5, and thus encounters no resistance from it. This behaviour simulates rowing relatively accurately.

Conversely, when starting a proper stroke, beginning at the situation in FIG. 4, a user pushes on footrest 4 (to the right in the figures) and pulls on the handle 6 (to the left in the figures). Accordingly, the cord 7 between the handle 6 and the pulley 80 on the body 40 is forced to extend to the left. As a result, the handle 6 and footrest 4 move apart from each other, i.e. there is a mutual movement between the handle 6 and the footrest 4. The increased distance requires an extension of the section of the cord 7 between the handle 6 and the pulley 80 on the body 40, as can be seen in FIG. 3 as compared to FIG. 4. The total distance spanned by the cord 7 between its point of connection 500 to the pulley 80 closest to the handle 6 is shorter, since the total length of the cord 7 remains unchanged. Accordingly, the traveling pulley 81 must also move with respect to the elongate member 2 and the resistance element 5. As such, the traveling pulley 81 moves to the right in the figures, i.e. away from the resistance element 5, thereby providing slack in the cord 7. Said slack is taken up (or rather, caused) by the increased length of the section of the cord 7 between the handle 6 and the closest pulley 80 on the body 40.

Accordingly, movement of the footrest 4 on the body 40 with respect to the handle 6 requires movement of the traveling pulley 81. The movement of the traveling pulley 81 in turn actuates the resistance element 5, and thus encounters resistance from it. The resistance is therefore also encountered by the user, who moves the handle 6 with respect to the footrest 4. This behaviour simulates rowing relatively accurately.

Figure 5:
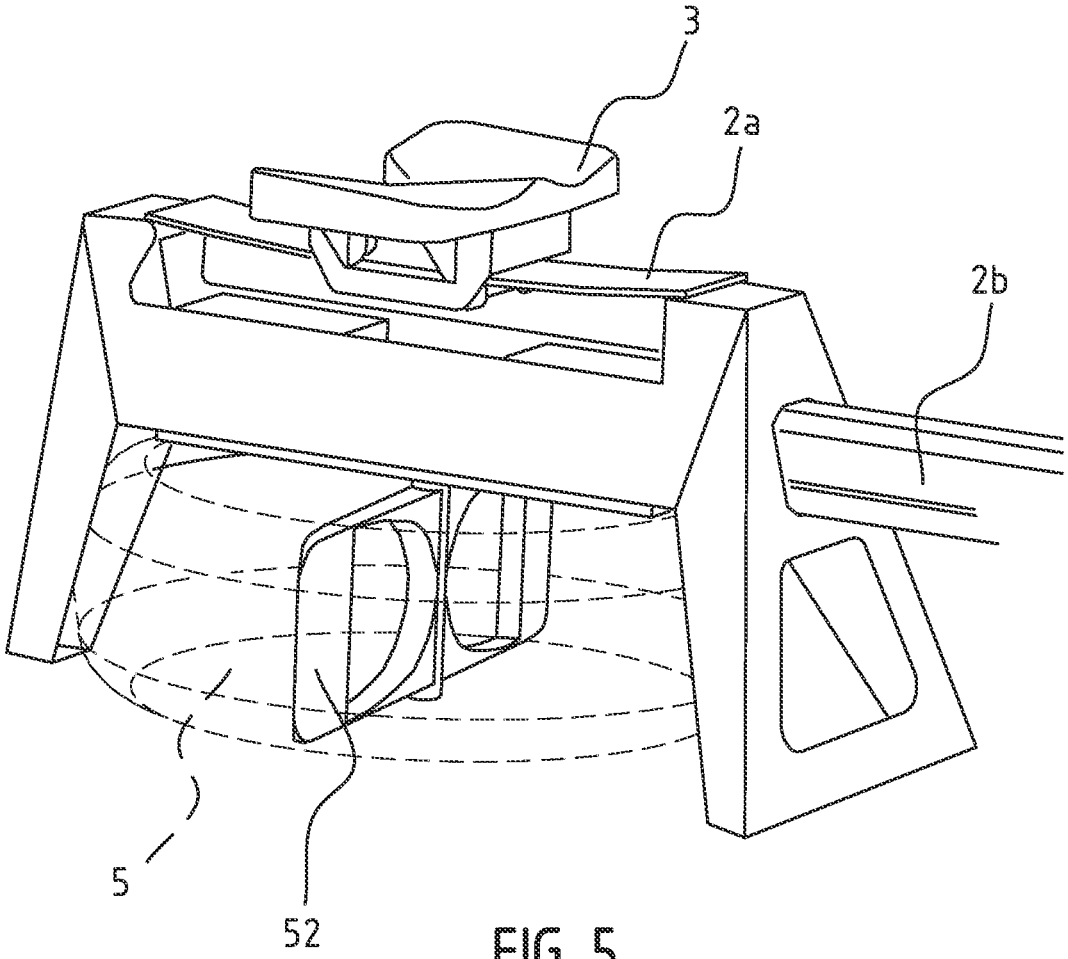
FIG. 5 shows a detailed perspective view of the rear end of the exercise device of FIGS. 3 and 4.

In FIG. 5, a close up view of a first track 2*a* and part of a second track 2*b* of an exercise device 1 is shown. A seat 3 is slidably arranged onto the first track 2*a*, as a result of which it can slide in a longitudinal horizontal direction of the first track 2*a*. The first track 2*a* comprises a resilient plate-like member such that the vertical position of the seat 3 is lowered by the weight of a user seated on the seat 3. Under the influence of the weight, the resilient member bends and the seat 3 lowers, such that the first track 2*a* is arc-shaped, the radius of which decreases with an increasing weight thereon. The first track 2*a* being arc-shaped results in a counterforce that counteracts a movement of the seat 3 along the first track 2*a* away from the lowest point on the resilient plate-like member. This resistance is intended to keep the user in place when the footrest 4 is pushed away from the seat 3 and pulled towards the seat 3 by the user. This improves the rowing simulation accuracy. Logically, the heavier the user the more the resilient plate-like member bends downwardly. Consequently, the resistance is increased, which is convenient as heavier users tend to be more powerful and therefore need more resistance to stay in place.

FIG. 5 further shows that the resistance element 5 comprises a paddlewheel 52 inside a housing of the resistance element 5. The housing is filled with a liquid, preferably water, such that upon rotation of the paddlewheel 52 a greater resistance to the rotation of the paddlewheel 52 is encountered in comparison with for example an air-based resistance element 5. The liquid decreases the amount of noise produced by the resistance element 5 to improve the experience of the user when using the exercise device 1, especially since the resistance element 5 is arranged at a height above the floor 10. The liquid further improves the simulation of rowing during use of the exercise device 1.

Finally, the exercise device 1 includes a display 96 mounted on a support 97 on the body. The display 96 may also be mounted on another part of the exercise device 1, such as a stationary part, in particular the track. The display 96 is configured to show exercise data obtained by a sensor arrangement 98, 99. The sensor arrangement 98, 99 (shown only in FIG. 5 for the sake of clarity), comprises a magnet 98 arranged on the paddlewheel 52 and a magnetic sensor 99 outside of the container 100 in which the paddlewheel 52 is arranged. When the paddlewheel 52 rotates in the container, the magnet 98 passes the magnetic sensor 99, which can register the rotation accordingly. The sensed rotation is then processed to provide exercise data to the user via the display 96.

The exercise device according to the present invention allows using a relatively heavy resistance element, by arranging it stationary with respect to the at least one track, whilst achieving an accurate rowing simulation by running the drive cord through a guiding member which is arranged stationary with respect to the movable footrest. As a result, a dynamic rowing machine can be provided with a relatively heavy resistance element and a relatively quiet resistance element that uses liquid while still retaining the beneficial features of dynamic rowing simulation machines.

The drawings are illustrative of selected aspects of the present disclosure, and together with the description serve to explain principles and operation of methods, products, and systems embraced by the present disclosure.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. An exercise device, comprising:

at least one elongate track onto which a seat and a footrest are slidingly movably arranged, such that the seat and the footrest are independently movable along the at least one track;

a resistance element connected to a handle via a drive cord through which the resistance element can be driven upon pulling the handle towards the seat; and a cord guiding member arranged between the handle and the resistance element over which the drive cord passes, wherein the cord guiding member is arranged substantially stationary with respect to the footrest so that the cord guiding member moves with the footrest, and wherein the resistance element is arranged substantially stationary with respect to the at least one track; and a cord guiding system that transfers only mutual movement of the handle and the footrest via the drive cord to the resistance element, but not a unitary movement of the handle and the footrest.

2. The exercise device according to claim 1, wherein the resistance element is arranged below the at least one track.

3. The exercise device according to claim 2, wherein the resistance element is suspended from the at least one track such that the resistance element is arranged above a floor on which the exercise device is installed.

4. The exercise device according to claim 1, wherein the resistance element comprises a flywheel configured to generate drag upon rotation thereof.

5. The exercise device according to claim 4, wherein the flywheel is arranged horizontally.

6. The exercise device according to claim 4, wherein the flywheel comprises an impeller arranged in a closed container at least partially filled with liquid configured to provide resistance to the impeller upon rotation thereof.

7. The exercise device according to claim 6, comprising a sensor arrangement configured to sense rotational speed of the impeller through the closed container, preferably during both work and rest phases in operation of the exercise device.

8. The exercise device according to claim 1, further comprising a body which is slidingly movably arranged onto the at least one track, wherein the footrest and the cord guiding member are mounted on the body.

9. The exercise device according to claim 8, wherein the cord guiding member is mounted on the body at a distance from the at least one track at approximately equal height as the handle when held by a user during use of the exercise device.

10. The exercise device according to claim 1, wherein the drive cord is directly connected to the resistance element, such that a pulling force exerted on the handle and a resistance force provided by the resistance element are coupled directly.

11. The exercise device according to claim 1, wherein the drive cord is indirectly connected to the resistance element via a travelling pulley, such that a pulling force exerted on the handle and a resistance force provided by the resistance element are coupled indirectly.

12. The exercise device according to claim 1, further comprising a bias element configured to urge each of the handle and the footrest towards a starting position, the starting position being a position of the handle and the footrest when no external force is applied.

13. The exercise device according to claim 12, further comprising a tensioner configured to apply a force on the drive cord to create and maintain tension on the drive cord, wherein the tensioner is integrated with the bias element.

14. The exercise device according to claim 1, wherein the resistance element is connected via the drive cord to the footrest such that the resistance element can be driven through the cord upon pushing the footrest away from the seat.

15. The exercise device according to claim 1, wherein the cord guiding member is a pulley.

16. The exercise device according to claim 1, wherein the at least one track comprises a first track and a second track, wherein the seat is slidingly movably arranged on the first track and the footrest is slidingly movably arranged on the second track, wherein the first and second tracks parallel to each other.

17. The exercise device according to claim 16, wherein the first track is arranged higher than the second track.

18. The exercise device according to claim 1, wherein the first track comprises a resilient plate member onto which the seat is movably arranged, wherein the seat is slidingly movable, and wherein the resilient plate-like member has a spring constant such that a vertical position of the seat is lowered by a weight of a user seated on the seat.

19. The exercise device according to claim 1, the exercise device being a rowing simulator.

20. The exercise device according to claim 1, wherein the drive cord comprises two ends, one end of the two ends is fixed to the handle and the other end of the two ends is stationary with respect to the footrest, wherein the drive cord extends around a travelling pulley, which is movably arranged with respect to the resistance element, wherein movement of the travelling pulley engages the resistance element.

* * * * *